US005113044A

United States Patent [19]

Tomberlin

[11] Patent Number: 5,113,044

[45] Date of Patent: May 12, 1992

[54] ONE-WAY/THREE-WAY LIGHT SOCKET

[76] Inventor: Rand K. Tomberlin, 4017 N. Bennington, Apt. 104, Kansas City, Mo. 64117

[21] Appl. No.: 716,138

[22] Filed: Jun. 17, 1991

[51] Int. Cl.[5] ..... H01R 19/00

[52] U.S. Cl. ..... 200/51.04; 315/362; 439/168; 439/220; 439/614; 439/640; 200/51.17; 200/51.05; 200/51.06; 200/51.11; 200/51.14

[58] Field of Search ..... 439/168, 174, 220, 189, 439/613, 614, 638, 640, 641; 200/51 R, 51.02, 51.03, 51.04, 51.05, 51.06, 51.11, 51.14, 51.17; 361/362

[56] References Cited

U.S. PATENT DOCUMENTS

| | | | |
|---|---|---|---|
| 551,357 | 12/1895 | Beal . | |
| 664,554 | 12/1900 | Hussey . | |
| 712,149 | 10/1902 | Paiste . | |
| 860,325 | 7/1907 | Phelps . | |
| 1,824,600 | 9/1931 | Kinzler | 439/641 |
| 2,092,996 | 5/1936 | Wilkins . | |
| 2,203,762 | 1/1939 | Zagmester . | |
| 2,222,655 | 11/1940 | Dulberg | 200/51.03 |
| 2,505,518 | 4/1950 | Benander | 200/51.06 |
| 2,701,868 | 2/1955 | Pate et al. | 439/614 |
| 3,028,525 | 4/1962 | Morton | 439/614 X |
| 3,739,118 | 6/1979 | Bounds | 200/51.03 X |

*Primary Examiner*—Ernest G. Cusick

*Attorney, Agent, or Firm*—Kokjer, Kircher, Bowman & Johnson

[57] ABSTRACT

A light socket having a standard contact and switch arrangement for standard operation with three-way incandescent light bulbs. In addition to the standard main switch, the socket also includes a secondary mode switch operatively connected to the appropriate terminals such that placing the mode switch in a first position will provide proper operational sequence with a three-way light bulb, while placing the mode switch in a second position will provide the proper operational sequence for a one-way light bulb. This mode switch may also be provided in an adapter which is formed to be received within the receptacle of a standard three-way light socket, and which also includes a standard receptacle for the receipt of the light bulb.

6 Claims, 2 Drawing Sheets

ONE-WAY/THREE-WAY LIGHT SOCKET

BACKGROUND OF THE INVENTION

1. Field of the Invention

The present invention relates in general to light sockets for incandescent light bulbs. In particular, the present invention relates to an improved socket allowing proper operation with both one-way and three-way light bulbs.

2. Description of the Related Art

Standard one-way (on/off) incandescent light bulbs and sockets having a manual switch have been known for a great number of years. It has also been known to provide incandescent light bulbs having two filaments which can be separately or simultaneously energized, along with appropriate sockets having manual switches to form a three-way light (high/medium/low/off).

In both of these arrangements, the light bulb includes a first contact formed by the threaded end used to retain the bulb within the socket and a second contact formed at the center of this threaded end and insulated from the threaded terminal. The filament of the bulb is connected between these contacts. Modern three-way light bulbs include a third terminal in the form of an annular ring which extends concentrically between, and is insulated from, the first and second terminals. The second filament of the three-way bulb extends between the first and third contacts.

This common placement of the first and second terminals has allowed one-way and three-way light bulbs to be used interchangeably in one-way or three-way light sockets. As may be readily envisioned, a one-way socket (using only the first and second contacts) will produce only an on/off action regardless of whether a one-way or a three-way light bulb is employed therein. When a three-way light bulb is employed in a three-way socket, the normal high/medium/low/off operation of the three-way light bulb is possible. However, where a one-way light bulb is employed in a three-way socket, the terminal and switch arrangements have resulted in an on/on/off/off activation sequence.

This activation sequence for a one-way light bulb received in a three-way socket is technically operable, in that the bulb will turn on and off. However, the need to manually activate the switch on the socket twice, rather than the expected once, to turn the light on or off is a continuing source of annoyance. This is often aggravated by the manual switch on the socket being located at an inconvenient and obscured position beneath the lamp shade.

SUMMARY OF THE INVENTION

An object of the present invention is to provide a light socket which provides normal operation with both one-way and three-way incandescent light bulbs.

Another object of the present invention is to provide a light socket adapter for a three-way light socket which allows the normal operation of both one-way and three-way light bulbs.

These and other objects are achieved by a light socket having a standard contact and switch arrangement for standard operation with three-way incandescent light bulbs. In addition to the standard main switch, the socket also includes a secondary mode switch operatively connected to the appropriate terminals such that placing the mode switch in a first position will provide proper operational sequence with a three-way light bulb, while placing the mode switch in a second position will provide the proper operational sequence for a one-way light bulb. This mode switch may also be provided in an adapter which is formed to be received within the receptacle of a standard three-way light socket, and which also includes a standard receptacle for the receipt of the light bulb.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 9:
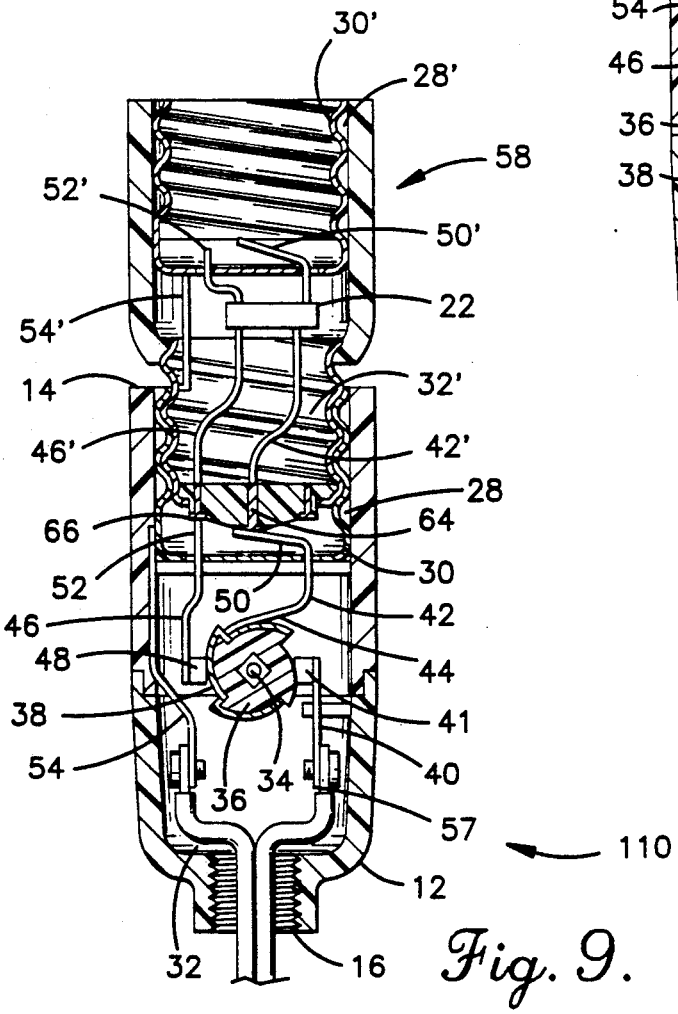
FIG. 9 is cross-sectional view of the adapter of FIG. 4 received within a standard three-way light socket.

With reference to FIG. 9, a standard prior art incandescent light bulb socket (employed with an adapter according to the present invention, which will is described below) is generally designated by reference numeral 110. The socket 110 includes an insulated outer casing 12 having a first end 14 adapted to received the incandescent light bulb and a second end 16 adapted to be fixed to a lamp and allowing access to the interior of the socket for wiring. As is well known, the outer casing 12 includes a cutaway 18 (similar to that shown in FIG. 1) which allows a knob 20 (also similar to that shown in FIG. 1) to extend outwardly of the casing while being operatively connected to the various contacts of the socket 10. The knob 20 may be of the standard variety which causes activation of the socket by rotation of the knob 20.

The outer casing 12 defines a screw shell cavity 28 which receives a screw shell 30. As is known in the art, the screw shell 30 is formed of a conductive metal and includes appropriate threading to releasably retain an incandescent light bulb therein. Below the screw shell cavity 28 is formed a terminal cavity 32.

The terminal cavity 32 rotatably mounts a switch rod 34, with the knob 20 being fixed to one end of the switch rod 34 such that rotation of the knob 20 will cause rotation of switch rod 34. Mounted on the switch rod 34 within the terminal cavity 32 is a contact member 36 formed of a dielectric material. The contact member 36 takes the general form of a disc having four ratchet teeth formed in the exterior periphery thereof. A peripheral contact strip 38, formed of an electrically conductive material, is formed about the periphery of contact member 36 such that the peripheral contact strip 38 covers and conforms to three of the four ratchet teeth.

A main contact strip 40 is located within the terminal cavity 32 such that a first portion 41 thereof is in contact with one of the ratchet teeth of the contact member 36. Main contact strip 40 is formed of an electrically conductive material and is somewhat resilient such that the first portion 41 may pass over the ratchet teeth and be biased inwardly towards the contact member to maintain engagement, and thus electrical contact, with the ratchet teeth. It is also noted at this point that the formation of the ratchet teeth prevents rotation of the contact member 36 in one direction.

A central contact strip 42 is also located within the terminal cavity 32, and strip 42 includes a first portion 44 in contact with the ratchet teeth of contact member 36 at a position 90 degrees away from the first portion 41 of the main contact strip 40, about the axis of rotation of the contact member 36.

The central contact strip 42 is formed of a conductive material and, like the main contact strip 40, is resilient such that the first portion 44 remains in contact with the ratchet teeth of contact member 36. The central contact strip 42 extends upwardly to form a central contact terminal 50 which extends from a central, insulated, position in the screw shell 30.

An outer contact strip 46 is also located within the terminal cavity 32, and, like the main contact strip and outer contact strip, is formed of a conductive material, is slightly resilient, and includes a first portion 48 biased into contact with the ratchet teeth of contact member 36. The first portion 48 of outer contact strip 46 is located ninety degrees away from the first portion 44 of central contact strip 42, about the axis of rotation of contact member 36.

In a manner similar to the central contact strip, the outer contact strip extends upwardly to form an outer contact terminal 52. The outer terminal 52 extends into the screw shell 30 at an outer, insulated, position for contact with the annular ring terminal of a standard three-way bulb.

A grounding contact strip 54 is fixed to the screw shell 30 as by soldering to allow electrical communication therebetween, and extends into the terminal cavity 32. In operation, an appropriate set of electrical wires would be introduced through the second end 16 of the socket and the positively charged wire connected to a terminal 57 on the main contact strip 40, as by a screw arrangement, and the negatively charged wire electrically connected to the grounding contact strip 54, as by a screw arrangement.

The operation of the prior art socket may be readily envisioned from consideration of the socket portion of FIG. 9. In the position shown the contact member is located with the insulated portion in contact with the main contact strip, and as such no circuit is formed and any bulb would be off. This is defined as the first position.

Rotation of the contact member (by rotation of the knob 20) ninety degrees counterclockwise will bring the contact member to the second position. In this position the peripheral contact strip 38 extends between the main contact strip and the outer contact strip, but the central contact strip is in contact with the insulated portion of the contact member. In this position a circuit will be formed through the low intensity filament of a three-way bulb, placing such bulb in the low operating condition. A one-way bulb, which has no annular ring terminal, remains in the off condition.

A further ninety degree rotation brings the contact member to the third position. In this position the main contact strip extends between the main contact strip and the central contact strip, with the outer contact strip in contact with the insulated portion of the contact member. A circuit would thus be formed through the medium intensity filament of a three-way bulb, placing such bulb in the medium operating condition. A circuit would also be formed through the filament of a one-way bulb, placing such bulb in the on condition for the first time.

A final ninety degree rotation brings the contact member to the fourth position. In this position the main contact strip extends between the main contact strip, the central contact strip and the outer contact strip. A circuit would thus be formed through both the low and medium intensity filaments of a three-way bulb, placing such bulb in the high operating condition. A circuit would also be formed through the filament of a one-way bulb, and such bulb would thus remain in the on condition.

Subsequent rotations of the contact member would step the contact member sequentially through the first through fourth positions, with resultant bulb conditions as described above.

As is readily apparent from the above description, a standard prior art three-way socket provides the proper operating sequence for a three-way bulb. Additionally, a one-way bulb will be placed in the on and off conditions when used in a three-way socket. However, the one way bulb operating sequence is off/off/on/on rather than off/on/off/on.

This disparity in the operating sequence for a one-way bulb is overcome by the convertible socket of the present invention. This socket is shown in FIG. 1, where like reference numerals denote like elements.

Figure 1:
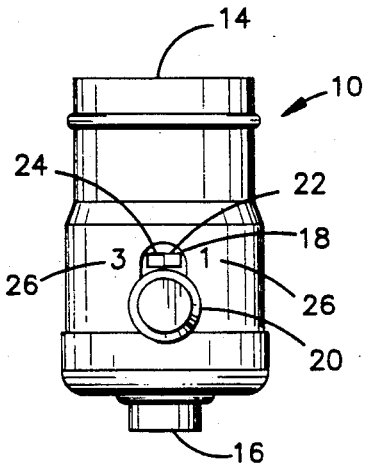
FIG. 1 is a side view of a light socket according to the present invention.

A socket 10 of FIG. 1 varies from prior art sockets in that the cutaway 18 is enlarged to allow access to a mode switch 22 from the exterior of the socket 10. The mode switch 22 includes a knob 24 which may be manually moved between first and second positions to activate the switch 22. Adjacent the switch 22, indicia 26 is formed on the exterior of the socket, as by stamping, to indicate the operational mode of the socket 10, as will be better described below.

The various strips and terminals of socket 10 are similar to that of socket 110 of FIG. 9, except that the central contact strip and terminal, and outer contact strip and terminal are connected to the mode switch 22 such that outer contact strip 46 is continuously in electrical communication with outer contact terminal 52. Switch 22 does function, however, to connect the central contact terminal 50 alternatively between the central contact strip 42 and outer contact strip 46. The switch 22 thus serves to modify the current flow through this terminal as is best described with reference to FIGS. 2 and 3.

In these figures the contact member 36 is indicated by a circle having four quadrants, with the open quadrants indicating that portion of the contact member which is surrounded by the peripheral contact 38. Therefore, the quadrant which contains a checkerboard pattern is electrically insulated from the remainder of the contact member.

Figure 2:
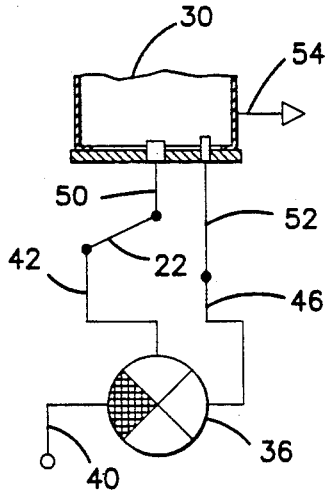
FIG. 2 is a schematic view of the socket of FIG. 1, with the mode switch in a first position.
Figure 3:
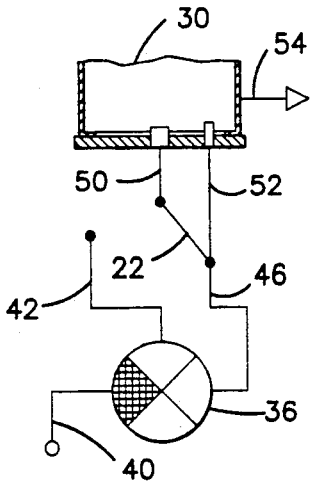
FIG. 3 is a schematic of the socket of FIG. 1, with the mode switch in a second position.

As is apparent from these figures, the switch 22 is a single pole double throw switch. FIGS. 2 and 3 represent the two respective positions which this switch may take. The operation of the socket will first be described with regard to the switch orientation shown in FIG. 2.

In FIG. 2 the switch 22 is in a position such that a circuit is formed between the central contact strip 42 and central contact terminal 50. This orientation of the switch corresponds to the setting employed when the socket is used with a three-way light bulb and also corresponds to the permanent circuit arrangement in the prior art three-way light socket 110.

The operational sequence of the socket 10 with the mode switch 22 in this position is identical to the operation described above with regard to the prior art socket 110, and as such will not be described again at this point. It is only noted that the switch 22 in FIGS. 2 and 3 is rotated clockwise through the first through fourth positions, rather than counter clockwise as in FIG. 9.

As the mode switch position shown in FIG. 2 corresponds to the prior art circuitry, it results in the prior art operational sequence of off/off/on/on when employed with a one-way bulb. However, movement of the mode switch 22 to the one-way position, illustrated in FIG. 3, avoids this problem.

In this position the central contact terminal 50 is electrically connected to the outer contact strip 46. As may be readily envisioned, when the contact member 36 is in the first position the insulated portion underlies the main contact strip 40, and the one-way bulb is not illuminated. However, when the contact member 36 is moved to the second position (by a ninety degree clockwise rotation), a circuit is formed through the main contact strip 40, the conductive peripheral contact member, the outer contact strip 46 and, via the switch 22, through central contact terminal 50. This causes the filament of the one-way bulb to illuminate.

Movement of the contact member 36 to the third position will place the outer contact strip 46 in contact with the insulated portion, thus causing no current to pass and the light bulb to be extinguished. Although the main contact strip 40 is connected to the central contact strip 42 via the peripheral contact member, mode switch 22 prevents electrical communication between the central contact strip and the central contact terminal.

Movement of the contact member 36 to the fourth position will again allow current to flow through the filament of the one-way light bulb in a manner analogous to that of position two. It may thus be seen that a one-way light bulb would operate in the normal and expected off/on/off/on operational sequence.

Figure 7:
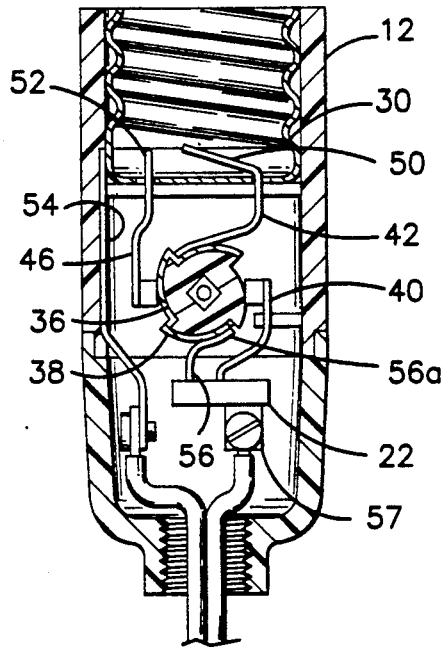
FIG. 7 is a cross-sectional view of the socket according to the embodiment of FIG. 5, showing the contact and switch placements.

This same effect may also be achieved by placing the switch 22 at a position "upstream" of the contact member 36. This embodiment is shown in FIG. 7, with like elements denoted by like reference numerals. As may be readily seen, the central contact strip and central contact terminal are formed as an integral unit in this embodiment, as in the prior art. This is also true of the outer contact strip and outer contact terminal. However, in addition to the main contact strip 40, this embodiment also includes a secondary contact strip 56.

As with the other contact strips, the secondary contact strip 56 is formed of a conductive material, and is slightly resilient such that a first portion 56*a* of the secondary contact strip may remain biased into contact with the ratchet teeth of contact member 36. As is shown in FIG. 7, the first portion 56*a* is located ninety degrees from the first portion of the outer contact strip, with respect to the axis of rotation of the contact member 36.

The main and secondary contact strips are both connected operatively to the mode switch 22. Additionally, the positive terminal 57 for connection of the appropriate wiring to the socket is also connected to the mode switch 22, such that mode switch 22 determines which of the main and secondary contact strips is operatively connected in the circuit.

The operation of the mode switch 22 in this embodiment, and thus that of the socket, is best illustrated with reference to the schematic drawings of FIGS. 5 and 6. It is noted that the insulating and conducting portions of the contact member 36 are identified in these figures identically to those in FIGS. 2 and 3, and that the contact member is rotated clockwise through the first through fourth positions.

Figure 5:
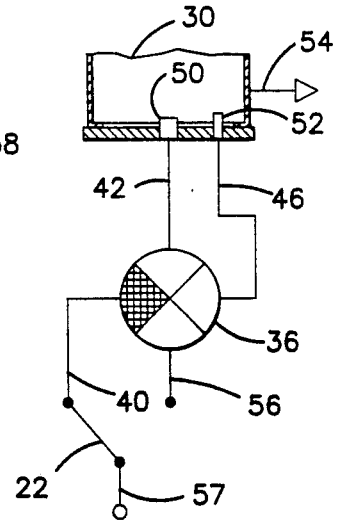
FIG. 5 is a schematic of a second embodiment of a socket according to the present invention, with the mode switch in a first position.

With reference to FIG. 5, the switch 22 is placed in the proper position for operation of the socket as a three-way socket. Comparison of FIGS. 2 and 5 will readily confirm that the path from terminal 57 through switch 22 and main contact strip 40 is equivalent to that in FIG. 2. Additionally, the central and outer contact strips and terminals are permanently arranged in an equivalent configuration to that shown in FIG. 2. As such, the operation of the circuit shown in FIG. 5 is identical to that described above with regard to FIG. 2 (and thus the prior art socket 110 of FIG. 9). Specifically, use of a three-way bulb within the socket arrangement shown in FIG. 5 will result in a standard off/low/medium/high operational sequence. The addition of the secondary contact strip 56 does not take part in the circuit of FIG. 5, and thus does not affect it in any way.

Figure 6:
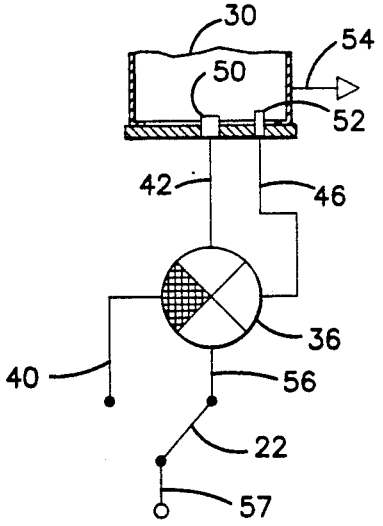
FIG. 6 is a schematic of the socket according to FIG. 5, with the mode switch in a second position.
Figure 4:
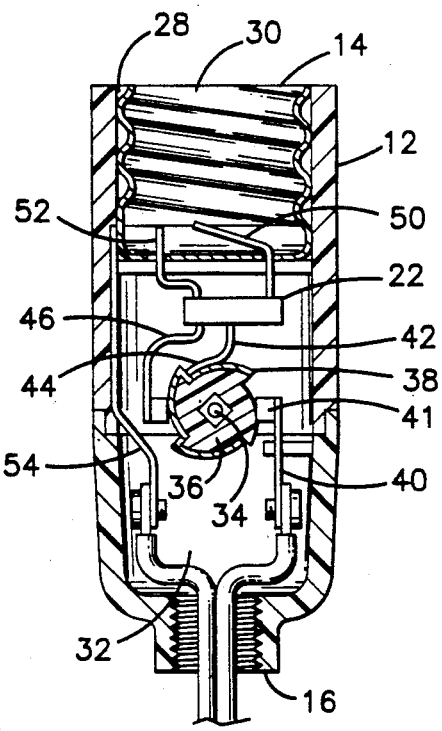
FIG. 4 is a cross-sectional view of the socket of FIG. 1 showing the contact and switch placements.

FIG. 6 represents the socket of FIG. 7 with the switch 22 placed in the proper position for use of the socket with one-way bulbs. In the first position of the configuration shown in FIG. 6, the current will flow from the terminal 57 through switch 22 and secondary contact strip 56 to the conductive periphery of contact member 36. Both the central and outer contact strips and terminals will therefore be capable of completing a circuit. However, since a one-way bulb includes only a central terminal, only this circuit will be completed, illuminating the bulb.

If the contact member 36 is rotated clockwise ninety degrees to the second position, the secondary contact strip will remain in communication with the peripheral contact strip, but the central contact strip 42 will be in contact with the insulated portion of the contact member, and as such the one-way lamp will not be illuminated.

Rotation of the contact member ninety degrees clockwise from this point to the third position will result in the insulated portion of contact member 36 lying beneath the outer contact strip 46. However, a circuit will be completed between the terminal 57 and central contact strip and terminal, thus causing the one-way bulb to illuminate.

A final ninety degree rotation of the contact member 36 to the fourth position will result in the secondary contact strip 56 being in contact with the insulated portion of the contact member 36. As such, no circuit can be completed and the one-way bulb will not be illuminated.

As may be readily seen, this operational sequence is the proper on/off/on/off sequence for a one-way bulb.

While a side view of the embodiment shown in FIGS. 5–7 is not shown, such a socket would look similar to that shown in FIG. 1, with the exception that the cutaway 18 would extend between the knob 20 and second end 16 of the socket, with the switch and indicia also being located between the knob 20 and second end 16.

While the previous two embodiments have addressed a socket having a built-in mode switch, a third embodiment of the present invention allows a standard three-way socket to be converted to a selectable socket as in the first two embodiments.

Figure 8:
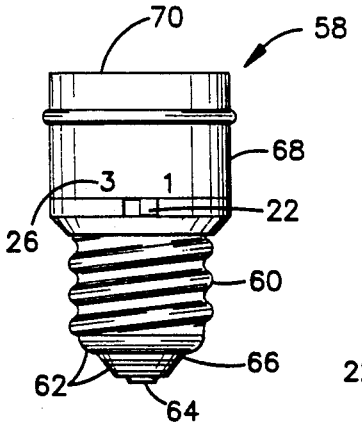
FIG. 8 is a side view of a socket adapter according to the present invention.

As shown in FIG. 8, this embodiment takes the form of an adapter generally designated by reference numeral 58. The adapter includes a screw contact 60, an insulated bottom 62, and a central contact 64 and annular outer contact 66, all similar to those found on a standard three-way incandescent bulb. Connected to the screw contact 60 is a body 68 which extends upwardly to a top end 70 and includes a mode switch 22 and indicia 26 as in the previous embodiments.

As is best shown in FIG. 9, the adapter 58 is formed to be received within a standard prior art three-way light socket 110 as would a standard three-way bulb. However, the body 68 of the adapter includes a screw shell cavity 28′ and a screw shell 30′ which open towards the top end 70. The screw shell 30′ is of a standard size and configuration to receive a standard incandescent bulb.

Below the screw shell cavity 28′ and within the screw contact 60 of the adapter is formed a terminal cavity 32′. This cavity contains the necessary elements to convey the electrical current from the standard three-way socket to the screw shell of the adapter.

Specifically, a grounding contact strip 54′ extends from the screw shell 28′ to the screw contact 60 of the adapter to provide electrical communication between these elements. Additionally, a central contact strip 42′ extends from the central contact 64 to the switch 22. Similarly, an outer contact strip 46′ extends from the annular contact 66 to the switch 22. Finally, extending outwardly from the switch 22 and into operative position within the screw shell 30′ are a central contact terminal 50′ and an outer contact terminal 52′.

The electrical connection between the various contact strips and terminals is modified by the switch 22 in a manner similar to the previous embodiments. Specifically, the electrical switching arrangement provided by the switch 22 is equivalent to that provided in FIGS. 2 and 3. In particular, the switch 22 allows the central contact terminal 50′ to be connected either to the central contact strip 42′ when used with a three-way bulb, or to be electrically connected to the outer contact strip 46′ when the adapter is employed with a one-way bulb. The operational sequences would be identical to those discussed above with regard to FIGS. 2 and 3.

While the present invention has been described with regard to specific embodiments, it should be noted that various modifications may of course be made without departing from the scope of the invention. For example, each of the embodiments has been described with a rotary knob and contact member having ratchet teeth. This could, of course, be modified to any standard switching arrangement including a push button type switch, or others. Additionally, the contact strips need not be resiliently biased into contact with the contact member, but need only maintain electrical communication.

From the foregoing it will be seen that this invention is one well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A socket for an incandescent light bulb and selectable between use with one-way and three-way bulbs, comprising:

an outer casing having a first open end;

a screw shell mounted within said casing and having a wall adapted to releasably retain, and make electrical contact with, a screw contact of the light bulb therein;

a central terminal mounted within, and electrically insulated from, said screw shell and adapted to make electrical contact with a central contact of the bulb;

an outer terminal mounted within said screw shell at a position intermediate said central terminal and said wall, said outer terminal being electrically insulated from said screw shell and adapted to make electrical contact with an annular ring contact of the bulb; and mode switch means operatively mounted to said socket for modifying the electrical outputs of said central and outer terminals such that in a first position of said switch a one-way bulb in said socket will have an off/on/off/on operational sequence, and in a second position of said switch a three way bulb will have a normal operational sequence.

2. A socket as in claim 1, further comprising a main switch mounted within said casing and adapted to selectively direct current to said central and outer terminals.

3. A socket as in claim 2, wherein said main switch is rotatably mounted, in substantially 90 degree increments, within said casing with each of said increments defining first through fourth positions sequentially in a direction of said main switch rotation, said main switch including a peripheral contact extending about substantially 270 degrees, in said direction of rotation, of said main switch, with the remainder of said main switch being electrically insulated, said socket further including a main contact adapted to be connected to a current source and in contact with said main switch at a first location thereon, a central contact strip in contact with said main switch at a second location substantially 90 degrees, in said direction of rotation, from said first location, and an outer contact strip in contact with said main switch at a third location substantially 90 degrees, in said direction of rotation, from said second location, whereby rotation of said main switch will cause various combinations of said main contact, central contact strip, and said outer contact strip to be in electrical communication.

4. A socket as in claim 3, wherein said central and outer terminals and said central and outer contact strips are operatively connected to said mode switch means, said outer terminal and said outer contact strip are in electrical communication, and wherein said mode switch means selectively allows said central terminal to be placed in electrical communication with said central contact strip, in said second position of said mode switch means, or said outer contact strip, in said first position of said mode switch means.

5. A socket as in claim 3, wherein said central contact strip is in electrical communication with said central terminal and said outer contact strip is in communication is in electrical communication with said outer terminal, and said socket further includes a secondary contact strip in contact with said main switch at a fourth location substantially 90 degrees, in said direction of rotation, from said third location, wherein said main and secondary contacts are operatively connected to said mode switch means, said mode switch means is adapted to be connected to the current source, and wherein said mode switch means selectively allows said main contact to be placed in electrical communication with said current source, in said second position of said mode switch means, or said secondary contact strip to be placed in communication with said current source, in said first position of said mode switch means.

6. A socket as in claim 1, wherein said socket comprises an adapter, said adapter further including:

an adapter screw contact having a free end and being mounted on said outer casing at a second end thereof, said adapter screw contact being in electrical communication with said screw shell and adapted to make electrical contact with a socket screw shell of a three-way light socket;

a central screw contact centrally located on said free end of, and electrically insulated from, said adapter screw contact and adapted to make electrical contact with a socket central contact of the three-way light socket; and an outer screw contact located on said free end of said adapter screw at a position intermediate said central screw contact and adapter screw contact, said outer screw contact being electrically insulated from said adapter screw contact and adapted to make electrical contact with a socket outer contact of the three-way socket; and wherein said central and outer terminals and said central and outer screw contacts are operatively connected to said mode switch means, said outer terminal and said outer screw contact are in electrical communication, and wherein said mode switch means selectively allows said central terminal to be placed in electrical communication with said central screw contact, in said second position of said mode switch means, or said outer screw contact, in said first position of said mode switch means.

* * * * *